US005847630A

United States Patent [19]

Arnold et al.

[11] Patent Number: 5,847,630

[45] Date of Patent: Dec. 8, 1998

[54] COMPACT CIRCUIT BREAKER INCORPORATING A POLYMER CURRENT LIMITER

[75] Inventors: David Arnold, Chester; Randall L. Greenberg, Granby, both of Conn.

[73] Assignee: General Electric Company, Plainville, Conn.

[21] Appl. No.: 905,063

[22] Filed: Aug. 1, 1997

[51] Int. Cl.[6] ..... H01H 75/12

[52] U.S. Cl. ..... 335/35; 335/201; 218/1; 218/158

[58] Field of Search ..... 335/23–5, 16, 335/147, 195, 201; 218/1, 143, 146, 147, 148, 149, 155–8

[56] References Cited

U.S. PATENT DOCUMENTS 4,513,268 4/1985 Seymour et al. ..... 335/35
4,963,849 10/1990 Kowalczyk et al. ..... 335/201
5,185,590 2/1993 DiVencenzo ..... 335/201
5,268,661 12/1993 Grunert et al. ..... 335/16
5,471,185 11/1995 Shea et al. ..... 335/47
5,495,083 2/1996 Aymami-Pala et al. ..... 335/201
5,614,881 3/1997 Duggal et al. .

*Primary Examiner*—Lincoln Donovan
*Attorney, Agent, or Firm*—Fishman, Dionne, Cantor & Colburn

[57] ABSTRACT

A compact current limiting circuit breaker utilizes a polymer current limiter, an arc rail and an arc gap for effective overcurrent protection. Upon the occurrence of contact separation an arc is drawn between the circuit breaker contacts and driven toward an arc rail. Commutation of the arc from the stationary contact to the arc rail effectively changes the current path to incorporate the polymer current limiter which rapidly suppresses the overcurrent. Circuit isolation is achieved by extinction of the arc within the arc gap between the movable contact and the arc rail.

10 Claims, 2 Drawing Sheets

COMPACT CIRCUIT BREAKER INCORPORATING A POLYMER CURRENT LIMITER

BACKGROUND OF THE INVENTION

The use of arc chutes in compact electric circuit breakers for the purpose of arc extinction is well known. The function of the arc chute is to extinguish the electric arc that is drawn between the movable and stationary contacts as they open in response to an overcurrent condition. The magnetic influence of the arc chute attracts the arc, which is then broken up into smaller arclets between the multiple plates within the arc chute. Each arclet defines an associated anode-cathode fall, which when taken collectively produces sufficient electrical potential to exceed the system voltage and drive the current to zero, thereby effectively extinguishing the overcurrent. One such arc chute is described in U.S. Pat. No. 4,963,849 entitled "Compact Current Limiting Circuit Breaker". During the interruption process, the intense heat of the ionized plasma arc vaporizes edges and surfaces of the arc chute plates, produces high internal gas pressures and causes ionized particles to be exhausted from the circuit breaker into the circuit breaker enclosure. In order to prevent an electrical strike to grounded metal during an interruption process, the performance of the circuit breaker must be coordinated with the constraints of the circuit breaker enclosure.

U.S. patent application Ser. No. 08/797,151 filed 10 Feb. 1997, entitled "Current Suppressing Circuit Breaker Unit for Inductive Motor Protection", describes a current suppressing unit connected in series with a pair of circuit breaker contacts. During a short circuit overcurrent condition, the current suppressing unit rapidly suppresses the short circuit let-through current which is then extinguished by the opening of the circuit breaker contacts. The current suppressing unit utilizes a current limiting element that operates in a manner described in U.S. Pat. No. 5,614,881, entitled "Current Limiting Device", to rapidly introduce high electrical resistance in series circuit with the arcing current to effectively limit the peak let-through current. The highly resistive current limiting element, in its switched state, rapidly suppresses the let-through current to a low residual value, which is then extinguished by the opening of the series-connected circuit breaker contacts. The resulting arc of the residual current is driven into an arc chute where it is extinguished in the manner described within the aforementioned U.S. Pat. No. 4,963,849.

One purpose of the invention is to provide an efficient short circuit interruption system that utilizes a current limiting element in place of an arc chute within a compact circuit breaker to provide the necessary electrical potential in excess of system voltage for suppressing and reversing the let-through current. A further purpose is to generate an arc gap between the movable contact and the current limiting unit when the contacts are separated to extinguish the resulting residual current.

SUMMARY OF THE INVENTION

A compact current limiting circuit breaker utilizes a polymer current limiter, an arc rail and an arc gap for effective overcurrent protection. Upon the occurrence of contact separation an arc is drawn between the circuit breaker contacts and driven toward an arc rail. Commutation of the arc from the stationary contact to the arc rail effectively changes the current path to incorporate the polymer current limiter which rapidly suppresses the overcurrent.

The polymer current limiter comprises a conductive polymer with abutting electrodes and higher resistance electrode interfaces. Adiabatic heating at the electrode interfaces causes rapid decomposition of the conductive polymeric material, resulting in partial separation of the electrodes and a substantial increase in resistance that suppresses the let-through current. Under quiescent operating conditions, circuit current passes through the circuit breaker contacts but not through the polymer current limiter, thereby eliminating an additional heat source within the polymer current limiter.

DESCRIPTION OF PREFERRED EMBODIMENT

Figure 1:
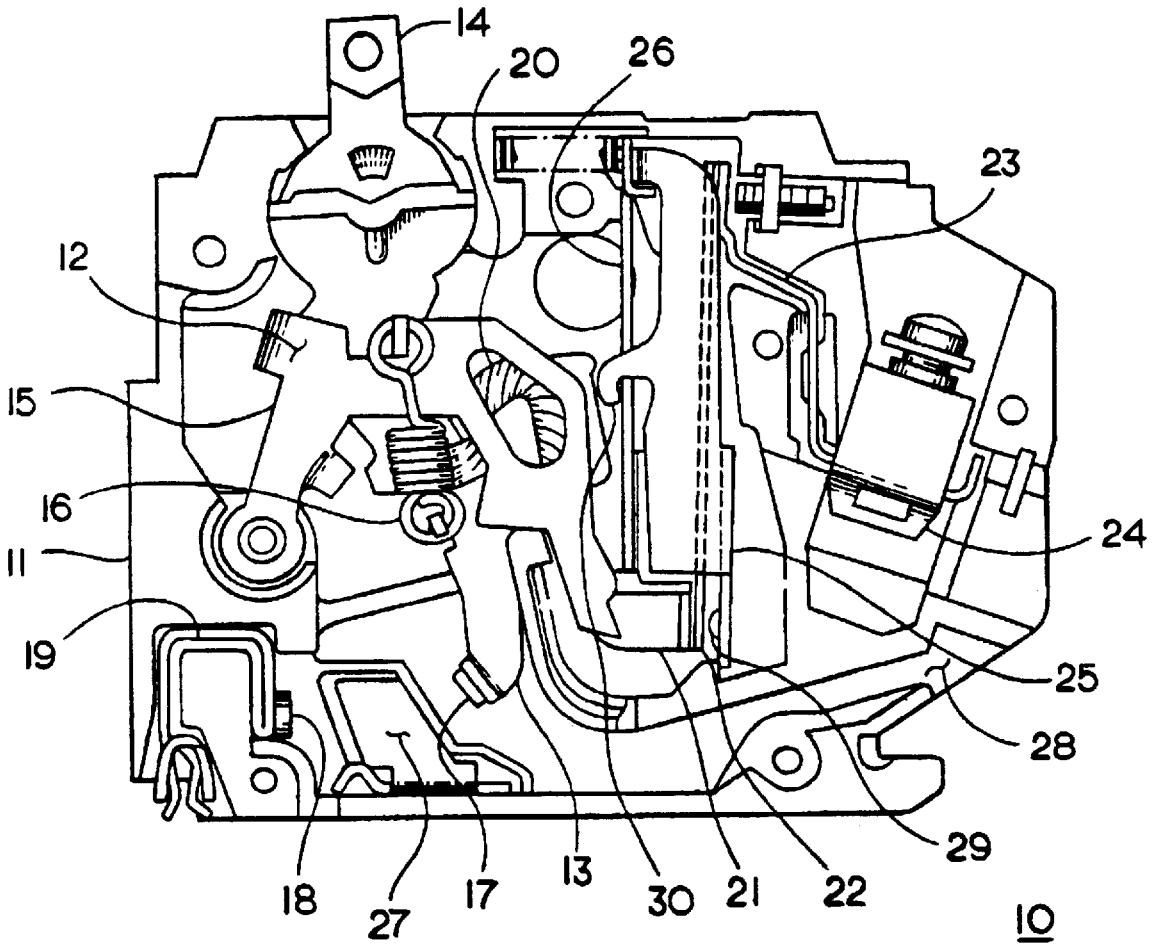
FIG. 1 (PRIOR ART)
FIG. 1 is a side view of a compact circuit breaker according to the Prior Art with the cover removed to depict the circuit breaker operating components in the "Off" condition.

FIG. 1 depicts a molded case circuit breaker 10 that operates in accordance with the teachings contained within U.S. Pat. No. 4,513,268 entitled "Automated Q-Line Circuit Breaker". A housing 11 contains an operating mechanism 12 that articulates contact arm 13 between an open and closed position for interrupting a protected circuit. Handle 14 cooperates with contact arm 13 by means of a cradle 15 and a mechanism spring 16 to effect closure of the protected circuit whereby the movable contact 17 abuts stationary contact 18. Line strap 19 contained with housing 11 provides an electrical connection between the external power source and the circuit breaker internal components. Under quiescent operating conditions, the electrical current passes through the line strap 19, stationary contact 18, movable contact 17, contact arm 13, braid 20, braid terminal 21, bimetal 22, and load strap 23. A load terminal 24 provides means to electrically connect the protected circuit to the circuit breaker. During an electrical over-current condition, the current passing through the bimetal 22 generates a magnetic field which is concentrated within magnet 25 and armature 26. Depending on the level of the over-current condition, either the bimetal 22 or the magnet 25 will effect separation of the contacts as described within the aforementioned U.S. Pat. No. 4,513,268. Thermal deflection of the bimetal 22 against projection 29 causes hook 30 to rotate armature 26 and release cradle 15 from a latch surface (not shown) permitting the stored energy in the mechanism spring 16 to actuate the contact arm 13. To ensure proper coordination between the bimetal 22 and the magnet 25, the current path is arranged within the magnetic circuit of the magnet 25 and armature 26. Opening of the contact arm 13 produces an electrical arc (not shown) that is directed towards the arc chute 27, with eventual extinguishing through an exhaust port as indicated at 28.

Figure 2:
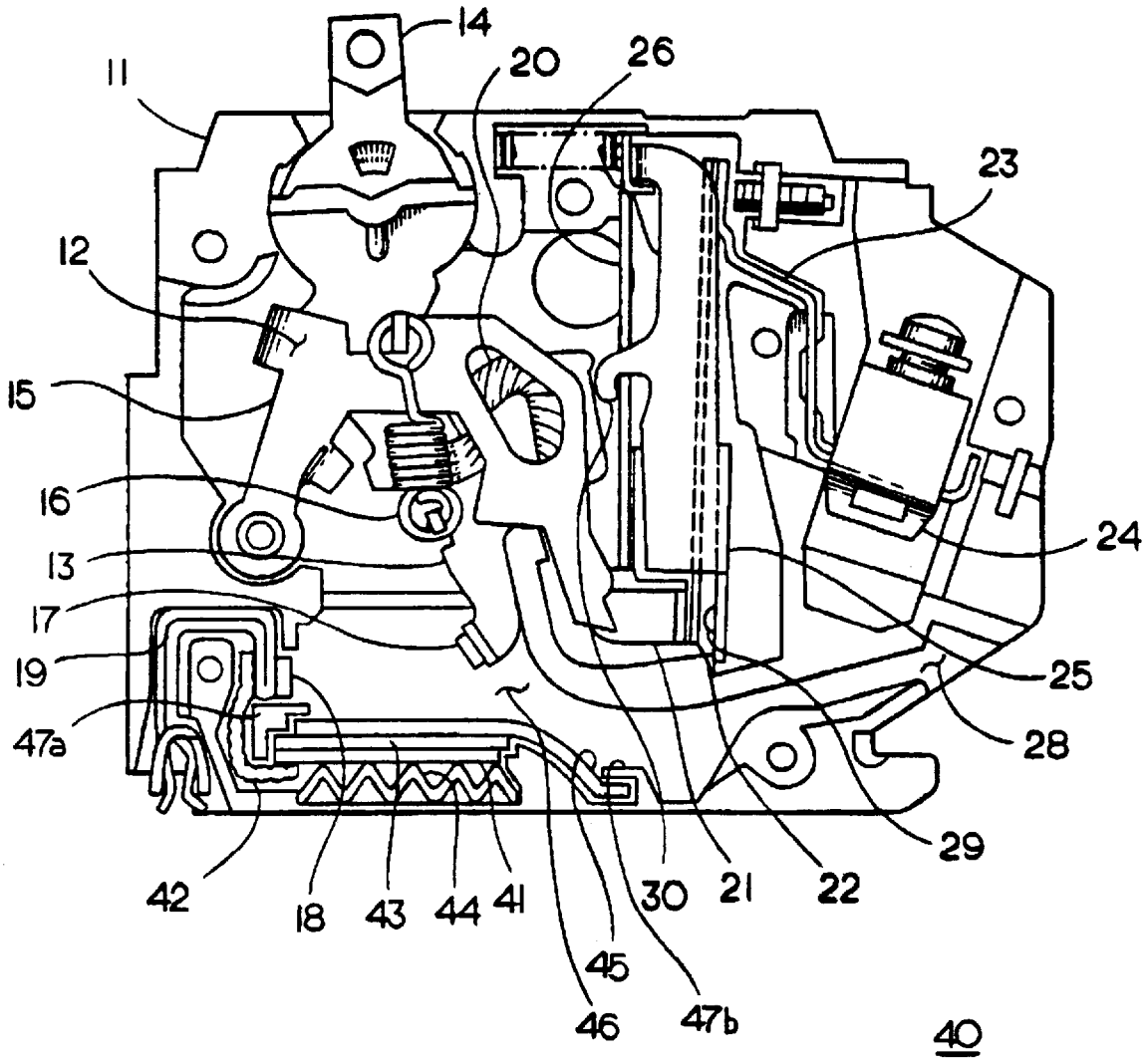
FIG. 2 is a side view of the circuit breaker of FIG. 1 equipped with a polymer current limiter in accordance with the invention.

A compact current limiting circuit breaker 40 is shown in FIG. 2, wherein like reference numerals with respect to FIG. 1 designate corresponding components. Line strap 19 connects to a first electrode 41 by means of line braid 42 and the first electrode is biased against one side of a polymeric conductor 43 by means of a spring 44. The opposite side of the polymeric conductor abuts an arc rail 45, which is captivated within the housing 11 by means of retainers 47*a*, 47*b*. Opening of the contact arm 13 produces an electrical arc that is magnetically driven towards the arc rail 45 by means of the current path configuration within the line strap 19 and contact arm 13. Commutation of the arc onto the arc rail 45 causes the short circuit current to pass through the polymeric conductor 43, first electrode 41, line braid 42 and line strap 19. Circuit interruption is effectuated by deflection of the bimetal 22 against projection 29 which causes hook 30 to rotate armature 26 and release cradle 15 thereby permitting the stored energy in the mechanism spring 16 to articulate the contact arm 13. The commutated current is rapidly suppressed by the action of the polymer current limiter which operates in the manner described within aforementioned U.S. patent application Ser. No. 08/797,151. The residual suppressed current across arc gap 46 is eventually extinguished through exhaust port 28.

We claim:

1. A compact current limiting circuit breaker comprising:

a circuit breaker housing;

a first contact arranged at one end of a contact arm and a second contact arranged at one end of a line strap, said first and second contacts being arranged within said housing for transfer of current through an associated protected circuit;

an operating mechanism within said housing arranged for separating said first and second contacts upon occurrence of an overcurrent condition in said protected circuit;

a trip unit within said circuit breaker housing for articulating said operating mechanism for separation of said first and second contacts to thereby create an arc current between said first and second contacts upon occurrence of said overcurrent condition;

a polymer current limiter including a polymeric conductor;

said polymer current limiter having an arc rail arranged proximate said second contact for commutating said arc current into said polymer current limiter for rapid suppression of said arc current; and an interface, proximate to and in series with said polymeric conductor in said protected circuit, having a higher resistivity than said polymeric conductor whereby said arc current causes resistive heating at said interface resulting in rapid thermal expansion and vaporization of said polymeric conductor at said interface causing at least partial separation at said interface thereby causing rapid suppression of said arc current.

2. The compact current limiting circuit breaker of claim 1 including means for fastening said polymer current limiter to said circuit breaker housing.

3. The compact current limiting circuit breaker of claim 1 wherein said polymer current limiter comprises said arc rail and a first electrode arranged on opposite sides of said polymeric conductor.

4. The compact current limiting circuit breaker of claim 3 wherein said polymeric conductor comprises a polymeric binder with a vaporization temperature at which significant gas evolution occurs below 800° C. and an electrically conductive filler.

5. The compact current limiting circuit breaker of claim 1 including means for exerting compressive pressure on said polymeric conductor.

6. The compact current limiting circuit breaker of claim 3 wherein said polymeric conductor does not require a PTCR effect.

7. The compact current limiting circuit breaker of claim 3 where said first electrode is electrically connected to said line strap.

8. The compact current limiting circuit breaker of claim 5 where said compressive means comprises a spring.

9. The compact current limiting circuit breaker of claim 2 where said fastening means comprises an interference fit within said circuit breaker housing.

10. The compact current limiting circuit breaker of claim 1 wherein said resistive heating is substantially adiabatic.

* * * * *